US006286395B1

(12) United States Patent
Frazier

(10) Patent No.: US 6,286,395 B1
(45) Date of Patent: Sep. 11, 2001

(54) SPHERICAL RATCHET

(76) Inventor: Thomas G. Frazier, 6512 Old Mill Cir., Watauga, TX (US) 76148

( * ) Notice: Subject to any disclaimer, the term of this patent is extended or adjusted under 35 U.S.C. 154(b) by 0 days.

(21) Appl. No.: 09/528,461

(22) Filed: Mar. 17, 2000

(51) Int. Cl.[7] ..... B25B 13/46
(52) U.S. Cl. ..... 81/60; 81/124.7; 81/177.2
(58) Field of Search ..... 81/60–63.2, 124.4, 81/124.6, 124.7, 125.1, 177.2, 177.5

(56) References Cited

U.S. PATENT DOCUMENTS

| | | | | |
|---|---|---|---|---|
| 226,582 | * | 4/1880 | Miller . | |
| 244,309 | | 7/1881 | Rhodes . | |
| 1,578,065 | * | 3/1926 | Bemus et al. | 81/177.2 X |
| 2,410,971 | | 11/1946 | Hartley . | |
| 2,564,356 | | 8/1951 | Dianda . | |
| 3,330,316 | | 7/1967 | MacNeill . | |
| 3,342,229 | | 9/1967 | Janes . | |
| 3,742,787 | | 7/1973 | Whiteford | 81/61 |
| 3,855,882 | * | 12/1974 | Wittmann | 81/124.7 |
| 4,086,831 | | 5/1978 | Smith | 81/62 |
| 4,235,269 | | 11/1980 | Kraus | 81/438 |
| 4,273,173 | | 6/1981 | Smith et al. . | |
| 4,448,097 | | 5/1984 | Rocca . | |
| 4,466,523 | | 8/1984 | De Carolis et al. | 192/43.1 |
| 4,542,667 | * | 9/1985 | Jang | 81/177.2 |
| 4,546,677 | | 10/1985 | Berkich | 81/62 |
| 4,748,874 | * | 6/1988 | Sharp et al. | 81/177.2 X |
| 5,461,950 | | 10/1995 | Iwinski | 81/61 |
| 5,528,963 | | 6/1996 | Wei | 81/63 |
| 5,749,271 | | 5/1998 | Liu | 81/60 |
| 5,832,791 | | 11/1998 | Lin | 81/62 |
| 5,848,680 | | 12/1998 | Rinner | 192/43.1 |
| 5,967,003 | * | 10/1999 | Lin | 81/58.3 |

* cited by examiner

*Primary Examiner*—D. S. Meislin
(74) *Attorney, Agent, or Firm*—Guy V. Manning

(57) ABSTRACT

A ratchet handle of generally spherical shape, the handle having an embedded ratchet mechanism near one surface, the drive post of which is accessible through a diametrical channel extending from the opposite side of the sphere. An extension rod inserted into the channel mates with the drive post and extends beyond the opposite surface of the handle a selected distance to a socket wrench which may be used to drive a fastener of corresponding size. Supplemental male and female post recesses accept additional extension rods serving as lever handles and fixed, non-ratcheted drives.

14 Claims, 2 Drawing Sheets

SPHERICAL RATCHET

BACKGROUND OF THE INVENTION

1. Field of the Invention

This invention concerns hand tools generally, and specifically hand held tools for turning and driving bolts, screws and the like. More specifically, this invention relates to a spherical ratchet handle for driving socket wrenches.

2. Description of Related Art

Because they are very useful, ratcheted, hand-held wrenches are ubiquitous. A ratchet wrench tool comprises an elongated handle adapted to rotate about the axis of a male drive post that couples to a cylindrical socket used to drive a threaded fastener, such as a bolt or screw. The ratchet drives the fastener by repeated turns of the wrench handle through an arc comprising a portion of a 360° sweep around the fastener axis. The ratchet mechanism embedded in the end of the handle above the post prevents unintentional reversing of fastener tightening when the handle is moved backwards. Rotation of the elongated handle through the full 360° of a single turn, however, may be hampered by nearby objects. Need commonly exists to overcome the drawbacks inherent in using such wrenches in tight quarters.

The typical solution is to provide an extension rod to offset the drive post vertically from the fastener so the handle can be rotated in more open space. Some confined situations, however, limit even this usage. A narrow or crooked access space can prevent a user from aligning an extension rod with the fastener axis, and extension rods may not be available or may be of inadequate length. In some applications, a user may be able to reach a fastener with his hand to turn it, even though he could not see it much less turn it with a conventional ratchet. A need exists for a tool useful in such situations.

For certain rotational motions, mis-alignment of the drive post and fastener axes can be problematic, especially for repetitive motions. Where a fastener must be kept precisely aligned (e.g. when first being started), a conventional, side-handle ratchet is awkward to use. Favoring accuracy over force, the user instead will grip the head of the ratchet and twist it without much help from elongated handle. A spherical ratchet handle would provide better leverage in such applications with the same desired control.

SUMMARY OF THE INVENTION

Accordingly, it is an object of this invention to provide a ratchet handle which nests comfortably and conveniently in the user's hand.

It is another object of this invention to provide a ratchet handle which, while aligned with a fastener, provides optimum leverage for driving the fastener.

It is another object of this invention to provide a spherical ratchet handle which doubles as a multiple tool device.

The foregoing and other objects of this invention are achieved by providing a ratchet handle of generally spherical shape, the handle having an embedded ratchet mechanism near one surface, the drive post of which is accessible through a diametrical channel extending from the opposite side of the sphere. An extension rod inserted into the channel mates with the drive post and extends beyond the opposite surface of the handle a selected distance to a socket wrench which may be used to drive a fastener of corresponding size. Supplemental male and female recesses accept additional extension rods that serve as lever handles and fixed, non-ratcheted drives.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
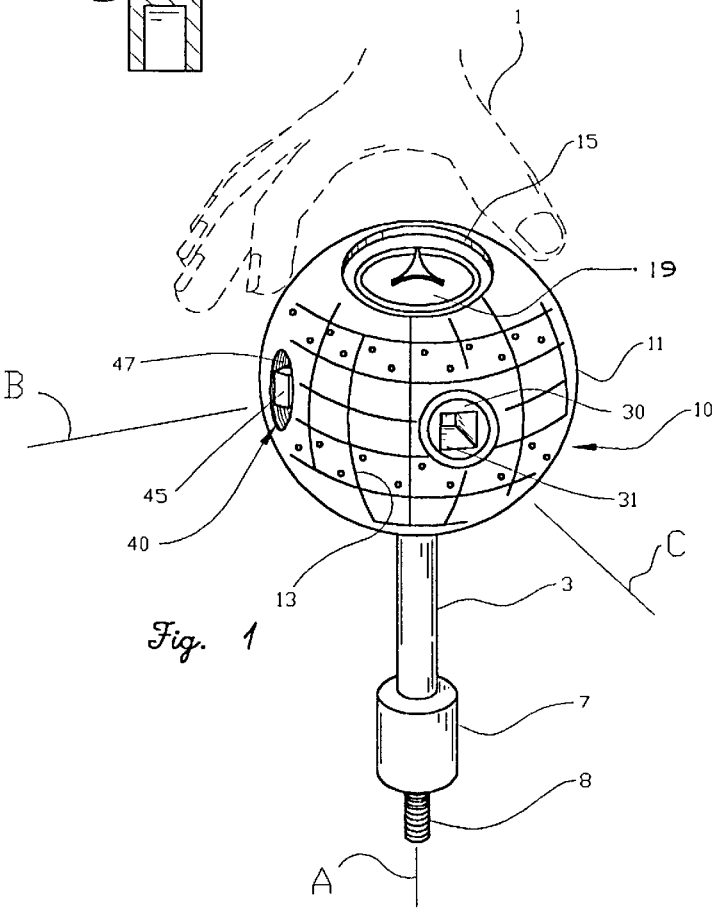
FIG. 1 depicts in perspective the spherical ratchet handle of the present invention, with an extension rod and socket in place.

With reference now to the figures, and in particular to FIG. 1, spherical ratchet 10 is shown disposed within user 1's grasp. Handle 11 of spherical ratchet 10 includes slip grip 13 arrayed around its surface covering a substantial portion thereof for frictional slippage deterrence. Extension rod 3 protrudes along axis A from the bottom of handle 11 and mates with socket 7 adapted to drive fastener 8. User 1 grips handle 11 with his fingers arrayed around the perimeter of handle 11 and his palm pressing against its upper surface opposite extension 3. User 1 rotates ratchet 10 in clockwise or counterclockwise direction about axis A either to drive or extract fastener 8.

Ratchet mechanism 19 is shown embedded within recess 15 in the top of handle 11. Ratchet mechanism 19 is shown in the figures as a circular, cylindrical device impressed within recess 15 in the top of handle 11. In such embodiment, ratchet mechanism 19 includes its own, self-contained chassis and may be a separately fabricated and purchased as catalog number 72-1109 (⅜" drive) available from Danaher Tool Group of Lancaster, Pa. Alternately, ratchet mechanism 19 may be a custom device fabricated to fit within recess 15, with necessary closure and retention baffles (not shown). Its salient traits are that it provides reversible ratcheting of angular rotation of extension rod 3 in response to rotation of spherical handle 11 about axis A. One having ordinary skill in the art will recognize that either of these alternate configurations and any others serving substantially the same purpose fall within the spirit and scope of the present invention.

Figure 4:
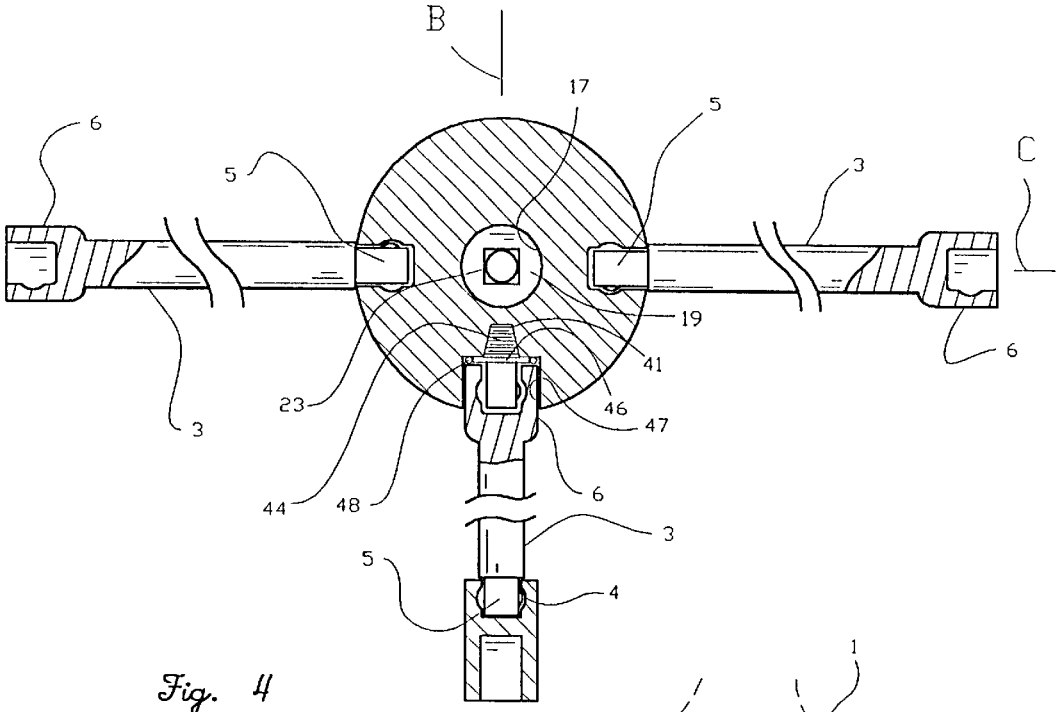
FIG. 4 shows yet another view of the spherical ratchet of FIG. 1 where the male post receptor shown in FIG. 2 also serves as an unratcheted, fixed drive tool.
Figure 2:
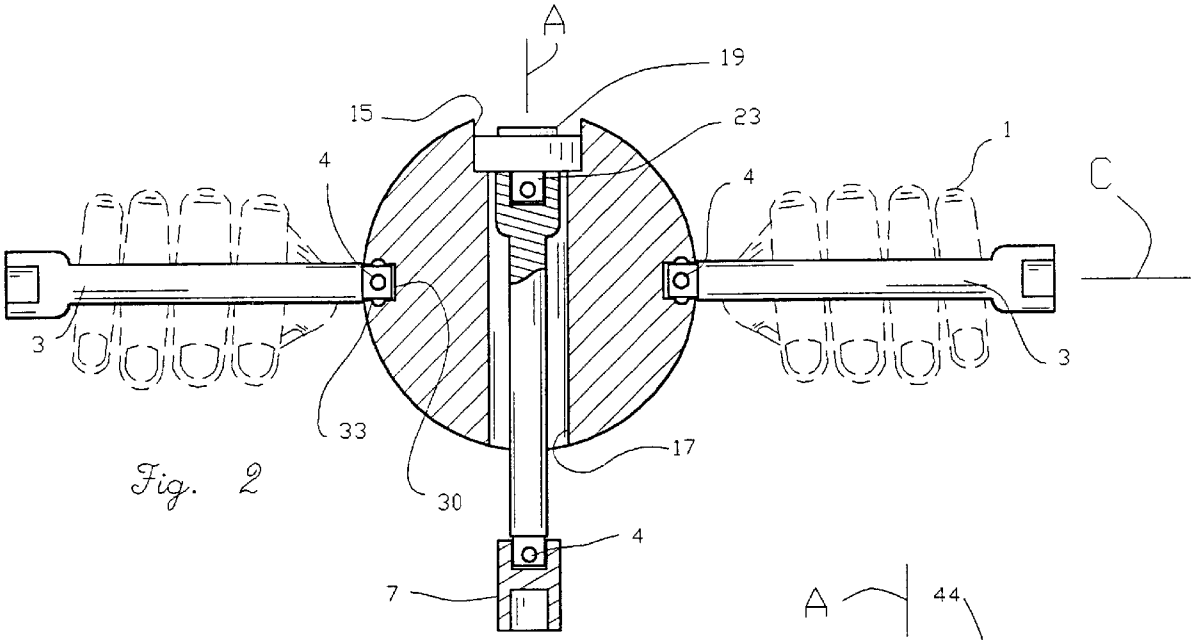
FIG. 2 is a cross section of the spherical ratchet of FIG. 1 showing female receptors receiving male ends of extension rods used as lever handles.
Figure 3:
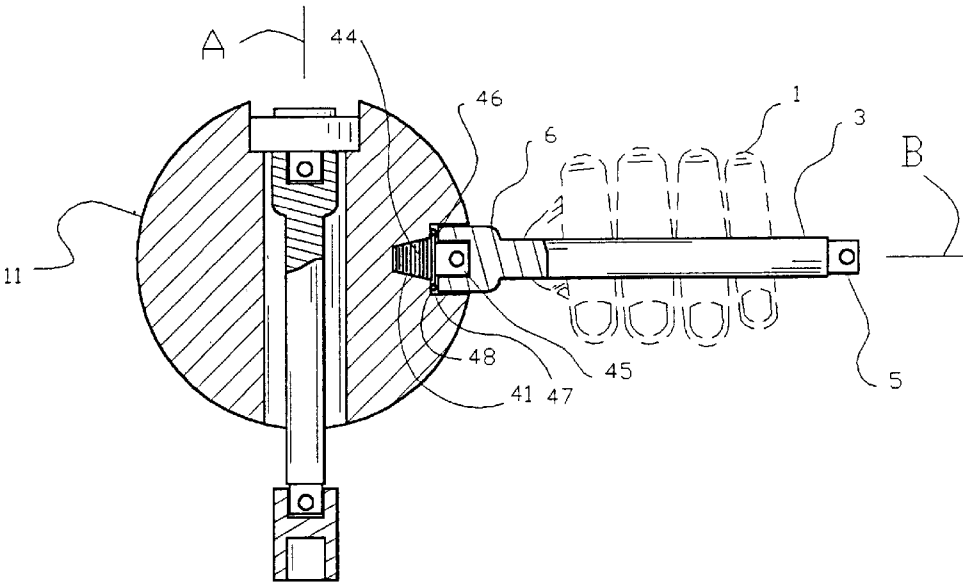
FIG. 3 shows a view similar to FIG. 2 but rotated 90° about axis A, wherein a single extension rod provides leverage, the rod being received by its female end by a male post receptor on the surface of the spherical ratchet.

While FIG. 1 illustrates the primary purpose of spherical ratchet 10, that of direct gripping and rotation by user 1, spherical ratchet 10 also may be used in alternate ways, as illustrated by FIGS. 2, 3 and 4. A plurality of male and female post receptors 30 and 40 are shown in FIG. 1 arrayed around handle 11, equitorially relative to axis A. For convenience in the following discussion, these will be discussed as located on axes B and C, said axes being arrayed in Cartesian relation to axis A. One having ordinary skill in the art will recognize, however, that receptors 30, 40 could be arrayed in many positions on the surface of spherical ratchet 10 and serve their purposes just as well.

FIGS. 2 and 3 illustrate using extension rods 3 to increase leverage on handle 11 by plugging them into receptors 30, 40. Receptors 30 comprise female fittings embedded in handle 11 flush with its surface at axis C on both sides of handle 11. Receptors 30 are adapted to receive the male ends 5 of one (not shown) or two extension rods 3 which serve as leverage handles for user 1. Receptors 30 are substantially identical to such receptors found on the butt end of socket 7 and on the female end of extension rods 3. Male ends 5 of extension rods 3 fit snugly within receptors 30 and permit user 1 to apply torque to socket 7. User 1 then grips extension rods 3 as handles to rotate socket 7 about axis A.

Male ends 5 of extension rods 3 commonly include one or more spring-biased ball bearings 4 protruding slightly from one or more of the flat facets of male end 5. Ball bearings 4 provide means for securing extension rods 3 within female receptors 30 (FIG. 2). It is common for the inside surfaces of such female receptor 30 to include scallops 33 adapted to receive ball bearings 4 as locks to retain extension rods 3 in place. Bearings 4 take up any slack which may be present because of a loose fit between male end 5 and the inside surfaces of receptor 30 disposed parallel axis C. Even where scallops 33 are absent, bearings 4 bear against the inside surfaces of receptors 30 to hold male ends 4 in place. Preferably, female receptors 30 include scallops 33 on all four faces of their inside surfaces, so that it matters not by which orientation extension rod 3 is inserted into receptor 30.

FIG. 3 illustrates alternate leverage means for handle 11 provided by using female end 6 of extension rod 3. Male post receptor 40 is shown disposed on axis B, embedded flush with the surface of handle 11. Within the recess of receptor 40, male post 45 extends to mate with female end 6 of extension rod 3. Bearing 4 is present on post 45 to secure post 45 within female end 6 as discussed above. User 1 applies torque to post 45 through extension rod 3 as discussed above. As shown in FIG. 3, handle 11 thereby becomes similar to a conventional ratchet tool with extension rod 3 serving as the elongated handle. This sometimes proves useful where very precise rotation is required, even though most of the force may be applied by user 1's other hand on spherical ratchet 10 as discussed above.

An additional feature of male post receptor 40 is illustrated in FIG. 4. Whereas female post receptors 30 mate with male ends 5 of extension rods 3, male post receptor 40 mates with the female end 6 of extension rod 3. This frees male end 5 for driving socket 7, as shown in FIG. 4. By this means, handle 11 becomes a non-ratcheted torsion bar. Because female post receptors 30 are arrayed on axis C in the plane of rotation about axis B, other extension rods 3 may be inserted in receptors 30 to provide additional leverage, as discussed above for FIG. 2 (see FIG. 4).

Receptors 30, 40 preferably are machined into a solid ball as discussed below. Female receptors 30 are machined by first drilling a pilot hole, then milling the sides of the hole into two pairs of opposing rectangular facets arrayed at ninety (90°) degrees to each other and paralleling axis C. Finally, scallops 33 are milled into the surfaces of each of the facets to complete female receptors 30.

Male post receptor 40 by contrast is fabricated in two parts. First, a hole is drilled into handle 11 to create pocket 47 (FIG. 2) at axis B on either one or two (not shown) sides of handle 11. Then, a second hole 41 of smaller diameter is drilled coaxial with pocket 47 deeper into handle 11 and threaded with suitable machine threads. Post 45 separately is milled to insert into pocket 47, with three regions along its longitudinal length. Male end 5 is milled with four facets and a ball bearing 4, just as it would be on the end of extension rod 3. Opposite male end 5, male threads 44 are adapted to mate with female threads within hole 41. Separating threads 44 from male end 5, flange 46 extends to substantially the diameter of pocket 47. Post 45 then is inserted into pocket 47 and screwed in using threads 44 until flange 46 limits its travel. Finally, welding bead 48 is run around the perimeter of flange 46 to affix it to handle 11 inside pocket 47 so that rotational torque applied through extension rod 3 cannot unscrew it.

Spherical ratchet 10 preferably is sized to fit comfortably within the palm of user 1's hand. It may range in size from approximately one and one-half (1½") inches to three or four inches in diameter before it becomes impracticable for a single user 1's hand. Preferably, spherical ratchet 10 is two (2" ) inches in diameter. Further, ratchet 10 preferably is machined from a solid ball of Type 316 stainless steel. A suitable ball for fabricating ratchet 10 is available as part number 1520090 (2" ball) from Industrial Techtonics of Dexter, Mich. One having ordinary skill in the art will recognize that handle 11 may be fabricated from other materials, especially hardened metals, without departing from the spirit and scope of the present invention.

In operation, user 1 inserts the female socket end of extension rod 3 into channel 17 until it contacts and mates with male post 23 of ratchet mechanism 19. Spring-bearings 4 mate with scallops 9 to retain rod 3 once it snaps into place. User 1 then fits socket 7 onto the male end of rod 3 and engages fastener 8 aligned with axis A. User 1 rotates handle 10 either clockwise or counterclockwise to turn fastener 8 in the direction desired, depending upon whether fastener 8 is to be driven in or extracted. If user 1 needs the extra leverage and has space to do so, he also may insert additional rods 3 into one or more of receptors 30, 40. In the configuration shown in FIG. 3, user 1 may continue to press on spherical ratchet 10 axially along axis A as he turns handle 11, partly with the pressing hand and partly with assistance from the leverage of extension rod 3. If user 1 needs even more leverage, and he has the space, he may remove his pressing hand and use both hands to rotate handle 11 as shown in FIG. 2. If yet additional torque is desired, user 1 may wish to relieve ratchet 19 from such stress. He instead can relocate rod 3 bearing socket 7 to male post receptor 40, thereafter using either hand pressure (as in FIG. 1) or extension rod 3 leverage as in FIG. 4.

It will be noted that the spherical shape of handle 10 is highly desirable. In such shape, it fits well within the palm of user 1's hand and provides a comfortable interface against which considerable downward pressure may be asserted without discomfort. Simultaneously, because of its selected diameter, it provides a grip to user 1's fingers which permits significant leverage to be applied to rotate socket 7. With as many as five fingers twisting on the spherical circumference of handle 11, much more force can be applied than with a conventional screw driver in similar application. Further, because user 1 employs both upper arm and forearm muscles to turn spherical ratchet 10, he can assert significantly more rotational force than possible with the conventional "handshake" grip used with a screwdriver.

Spherical ratchet 10 provides a plurality of configurations by which it may be used to drive or extract fasteners 8. As such, it displaces a number of different tools, such as ratchet handles, torsion bars and screw drivers, providing in their place a single tool. Even arrayed with a selection of extension rods 3, considerable weight and volume may be conserved by including spherical ratchet tool 10 in a tool box which other wise might include numerous other tools which serve the same purpose.

While the invention has been particularly shown and described with reference to a preferred embodiment, it will be understood by those skilled in the art that various changes in form and detail may be made therein without departing from the spirit and scope of the invention. For example, handle 11 has been shown and described as spherical, but its overall profile need not be confined to such shape. Alternate shapes (not shown) providing similar transverse leverage and a palm bearing surface may be substituted.

Further, handle 11 has been shown and described as a solid ball of metal, either steel or aluminum. It could, however, comprise a hollow shell (not shown) fabricated in two parts by conventional stamping or molding means. Receptors 30, 40 then would either be fabricated simultaneously as part of the stamping or molding, or could be fabricated separately and welded or otherwise affixed in place. For example, each receptor could be milled in the shape of a cup, circular or otherwise, and adapted to be recessed into handle 11 flush with its surface either by impressment or threaded and then welded to stay in place. Within each cup could be either a female or male receptor configured as needed for the specific location on handle 11. In fact, this method of fabrication could be employed for a solid ball handle 11 without departing from the spirit and scope of this invention. Finally, to the extent that such cup-style metallic receptors may be employed, handle 11 could be made from high strength, hydrocarbon plastics, such as high-impact polyurethane, having adequate characteristics of strength and geometric stability, and molded around said receptors.

I claim:

1. A ratchet tool comprising a handle body having an exterior surface;

a ratchet mechanism embedded within said body flush with the surface thereof and coaxial with a first axis of said body, said ratchet mechanism having a coaxial, male post adapted to couple to a female end of an extension rod;

an axial access channel extending through said handle body to the ratchet mechanism from the surface opposite the ratchet mechanism, said access channel adapted to provide access to the male post for a female end of an extension rod.

2. The ratchet tool of claim 1 wherein the handle body is substantially spherical.

3. The ratchet tool of claim 1 wherein nthe handle body comprises stainless steel.

4. The ratchet tool of claim 1 and further comprising a plurality of receptors disposed about the surface of the handle body and adapted to receive an end of an extension rod.

5. The ratchet tool of claim 4 wherein at least one receptor is disposed coaxial with a second axis through the handle body, the second axis being at right angles to at least one other axis of said handle body, said other axis being coaxial with at least one other receptor.

6. The ratchet tool of claim 4 wherein at least one receptor is positioned coaxial with a second diametrical axis through the handle body which is at right angles to the first diametrical axis.

7. The ratchet tool of claim 4 wherein at least one of the receptors is adapted to receive a male end of said extension rod.

8. The ratchet tool of claim 4 wherein at least one of the receptors is adapted to receive a female end of said extension rod.

9. The ratchet tool of claim 8 wherein the receptor further comprises a male post coaxial with and affixed within the receptor for mating with the female end of the extension rod.

10. The ratchet tool of claim 9 wherein the extension rod may be used both as a lever handle and as a second drive means for a socket wrench.

11. A method of inserting and extracting a threaded fastener, the method comprising providing a ratchet tool having a substantially spherical handle body;

a ratchet mechanism embedded within said body flush with one surface thereof and aligned with a first diametrical axis of said body;

a diametrical access channel through said handle body from a surface opposite the ratchet mechanism and coaxial with a first diametrical axis; and at least one receptor recessed into the surface of the body and coaxial with a second diametrical axis perpendicular to the first diametrical axis, said receptor being adapted to receive a end of a first extension rod; then inserting a female end of a first extension rod into the channel until it couples with a drive post on the ratchet mechanism; then coupling a socket wrench to the first extension rod opposite the drive post; then fitting the socket wrench onto a fastener and aligning it coaxial therewith;

rotating the handle body about the first axis to cause the socket to rotate.

12. The method of claim 11 and comprising the additional steps of inserting a second extension rod into one of the receptors; then applying moment force to the second extension rod to assist rotation of the handle body about the first diametrical axis.

13. A ratchet tool comprising a handle body;

a ratchet mechanism embedded within said body flush with a surface thereof and coaxial with a first axis of said body;

an axial access channel extending through said handle body from the ratchet mechanism to a handle surface opposite the ratchet mechanism;

a plurality of receptors disposed about the handle surface and adapted to receive an end of an extension rod; and a male post coaxial with and affixed within at least one of the receptors for mating with a female end of the extension rod.

14. The ratchet tool of claim 13 wherein the extension rod may be used both as a lever handle and as a second drive means for a socket wrench.

* * * * *